US005148556A

United States Patent [19]

Bottoms, Jr. et al.

[11] Patent Number: 5,148,556

[45] Date of Patent: Sep. 22, 1992

[54] WALL-CANTILEVERED SHOWERING APPARATUS

[76] Inventors: John E. Bottoms, Jr.; Veronica M. Bottoms, both of 7770 (#231) Regents Rd., La Jolla, Calif. 92122

[21] Appl. No.: 583,072

[22] Filed: Aug. 29, 1990

[51] Int. Cl.[5] ..... A47K 3/24

[52] U.S. Cl. ..... 4/567; 4/601; 4/615; 239/273; 239/283

[58] Field of Search ..... 4/567-570, 4/601-603, 605, 615; 239/272, 279, 282, 283

[56] References Cited

U.S. PATENT DOCUMENTS

| | | | |
|---|---|---|---|
| 6,047 | 1/1849 | Cortlan . | |
| 1,188,681 | 6/1916 | Rosenberg | 4/567 |
| 1,193,302 | 8/1916 | Seltner | 4/567 |
| 1,415,014 | 5/1922 | Booth . | |
| 1,616,514 | 2/1927 | Swimmer | 4/570 |
| 1,893,435 | 4/1931 | Neal . | |
| 2,100,186 | 7/1935 | Hagopian . | |
| 2,336,402 | 1/1943 | Kaiser . | |
| 2,380,665 | 7/1945 | Morris | 4/567 X |
| 3,698,020 | 10/1972 | Morris . | |
| 3,822,826 | 7/1974 | Wilson . | |
| 3,913,939 | 10/1975 | Wilson . | |
| 3,971,074 | 7/1976 | Yxfeldt . | |
| 4,142,257 | 3/1979 | Mace | 4/615 |
| 4,177,927 | 12/1979 | Simmons | 4/615 X |
| 4,397,050 | 8/1983 | Davis et al. | 4/570 X |
| 4,554,690 | 11/1985 | Knapp . | |
| 4,752,975 | 6/1988 | Yates . | |
| 4,865,254 | 11/1989 | Kragle . | |

*Primary Examiner*—Charles E. Phillips

[57] ABSTRACT

An improved stationary showering apparatus configured substantially as a loop water-manifold to be mounted overhead while one is standing thereunder; including a header plate mechanically affixed to an existing shower water-outlet pipe via a mechanical grip attachment sleeve with the header plate supporting a substantially ring like water-manifold showering device therefrom in a cantilevered fashion.

5 Claims, 2 Drawing Sheets

FIG.-1
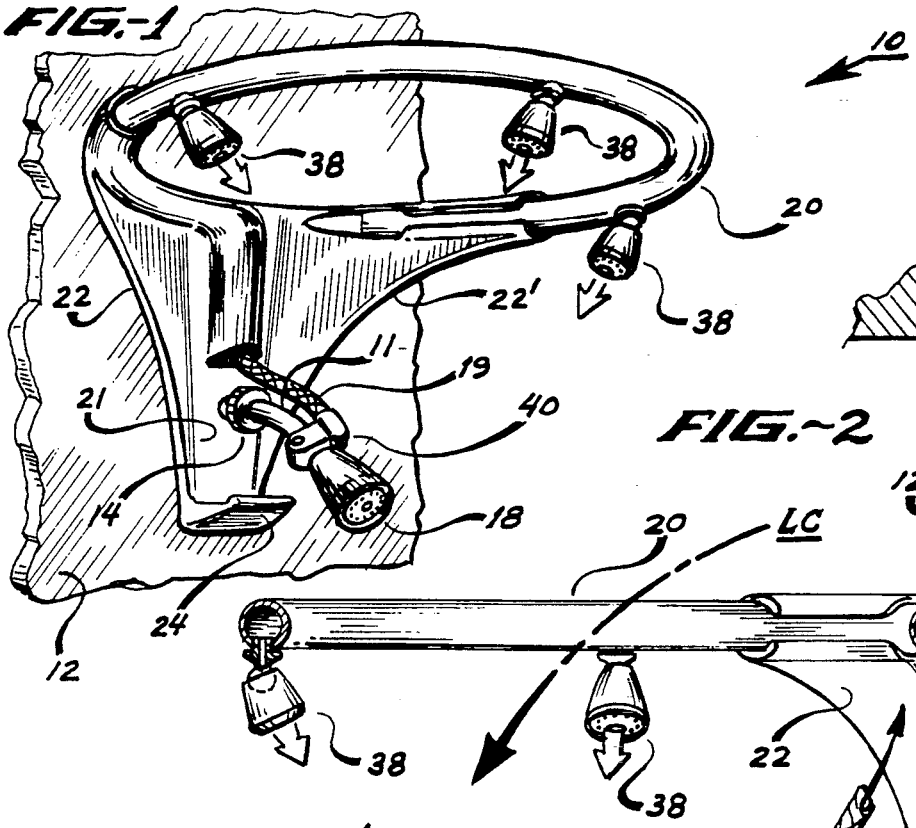
FIG.-2
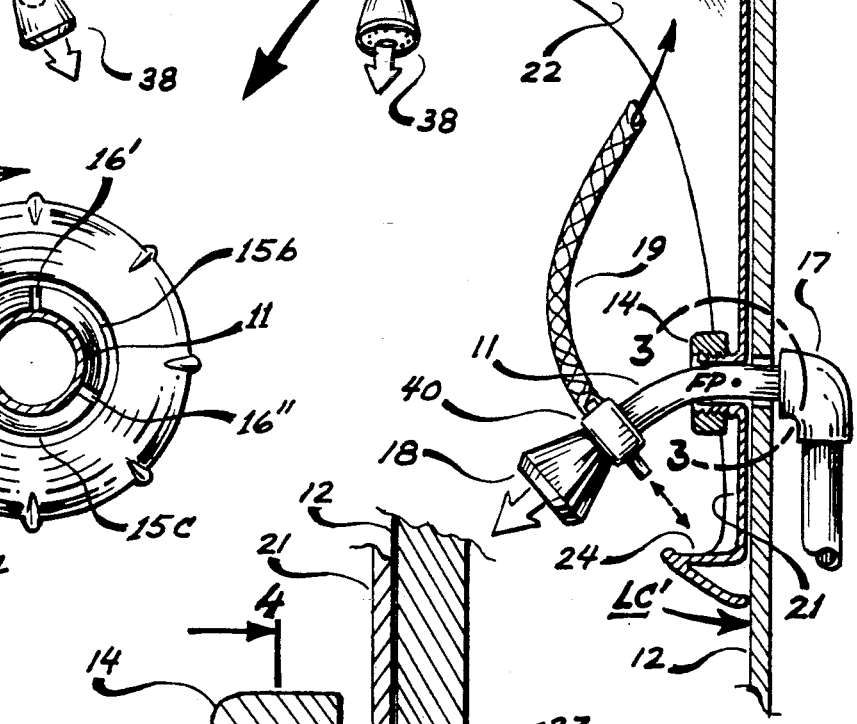
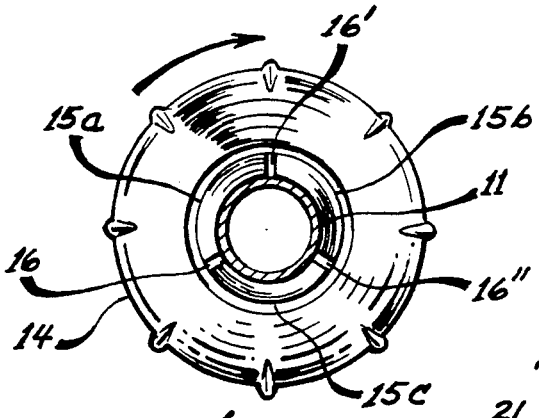
FIG.-4
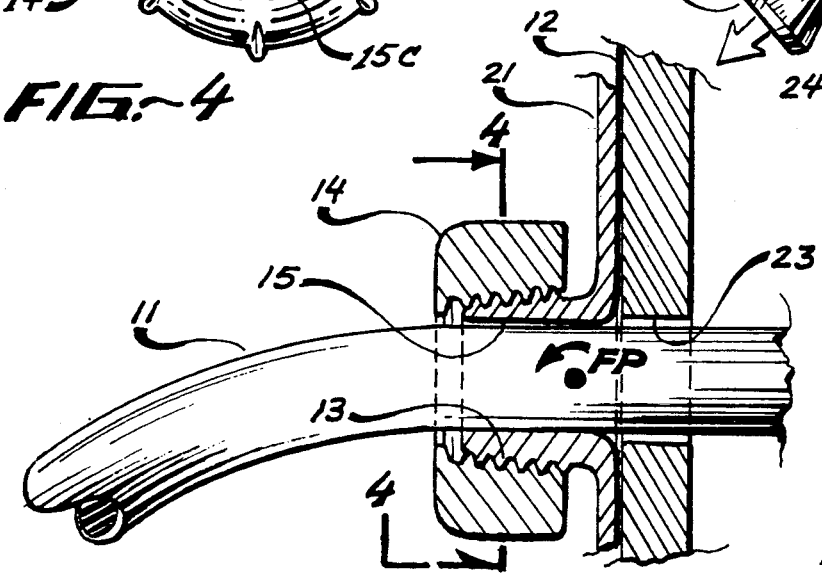
FIG.-3

FIG.-5
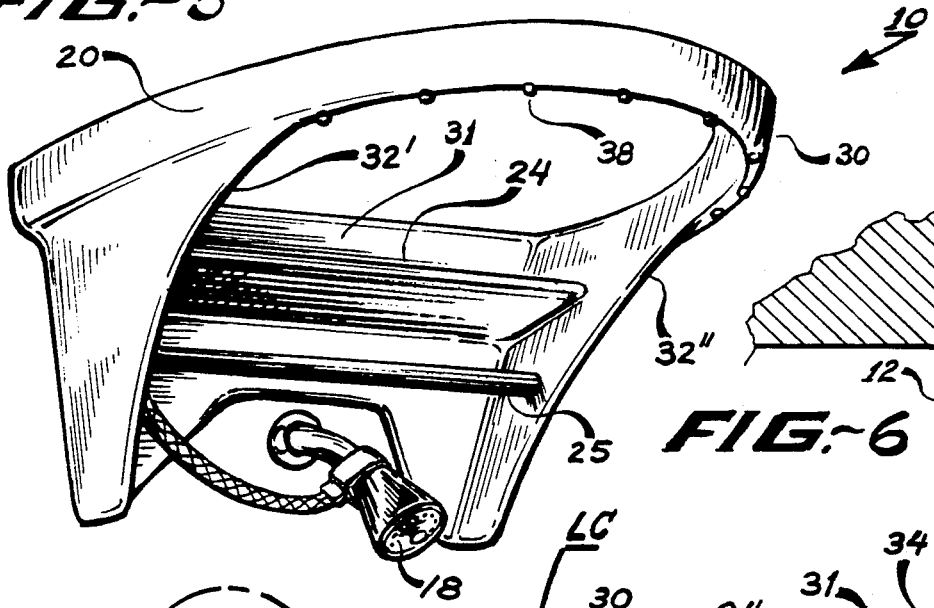
FIG.-6
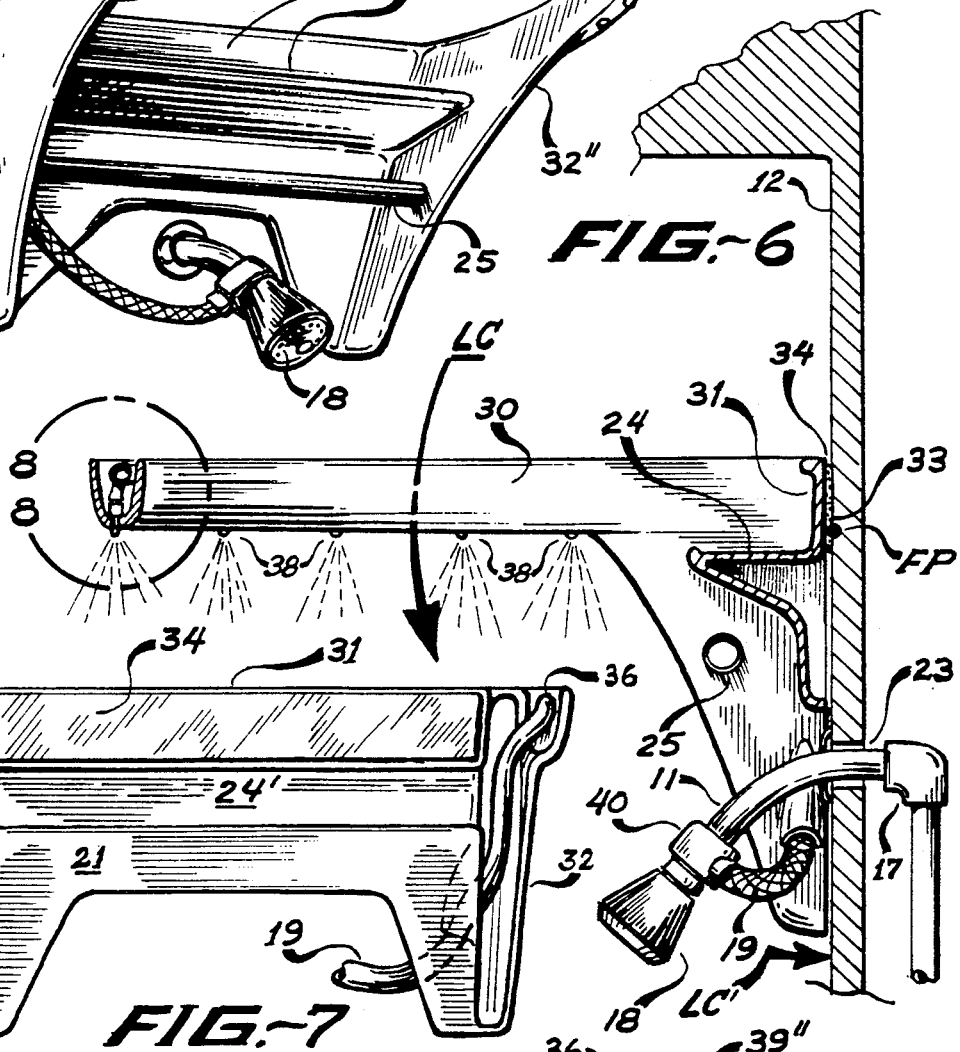
FIG.-7
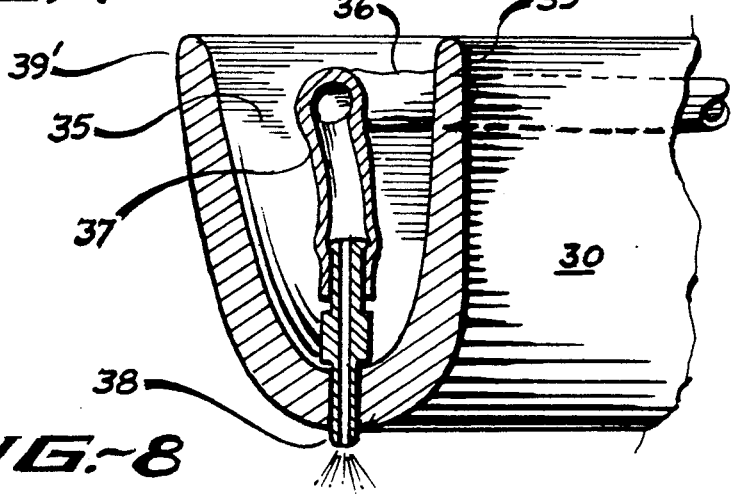
FIG.-8

WALL-CANTILEVERED SHOWERING APPARATUS

BACKGROUND OF THE INVENTION

This invention relates to overhead showering apparatus, and more particularly to such apparatus comprising a substantially annular or at least U-shaped loop manifold showering outlet portion; while in either case the outer or distal end portion of the manifold is to be a continuous loop extending around from one side outward and back to the wall region again, the purpose being to improve the overall effectiveness and enjoyment of the showering routine.

Heretofore, the most relevant known art is the 'Shower Bath Spray' (U.S. Pat. No. 1,893,435/filed 4-1931) which is not now on the market but certainly comprised an early attempt to provide the showering person an enhanced showering apparatus. This featured a central coaxial nozzle capable of being adjusted as to flow-rate via rotation of the nozzle body relative to a mating coaxial valve-seat. An annular nozzle in the form of ring like perforated manifold encircles the central nozzle, and includes two spoke like water-conduit elements feeding water outward from the coaxial central inlet, out into the annular nozzle portion, while the entire assembly is suspended from an overhead water-outlet pipe extending dowardward from the stall-shower ceiling. Unfortunately, this 60-year old configuration did not anticipate modern stall-shower construction, and is not really adaptable to today's typical wall water-outlet supply-pipe installations whereby the pipe exits the sidewall generally at a nominal height of 5'10" above the floor, which would make installation of the early invention rather impractical as to overhead use by most people.

Thus, the co-inventors of this present new and improved embodiment intend to provide a modern showering apparatus of suitably improvised structure of novel configuration is instantly adaptable to today's stall-shower and tub-shower construction; and is presently being prepared for production as the 'AquaHalo' TM under the auspices of the WATERHALO TM Mfg./Mkt.Company in Anchorage, Ak.

SUMMARY OF THE INVENTION

A.) Since a typical modern stall-shower or tub-shower installation finds the supply-pipe water-outlet extending from the wall at a height of about 5'10", it is therefore desirable to provide an overhead showering apparatus which can be installed substantially above the head of a 95%-tile standing man. Hence, it is an object of this invention to facilitate installation via one of two means or generic variant embodiments: 1.) via construction having a special header-plate extending fully across between two opposed right and left cantilevering wall support-brackets which stem outward from the wall at both sides of the overhead horizontal showering manifold. The flat header-plate being thus preferably equipped with a generous 1-inch X approximately 24-inch backing-strip of standard 3M (or equivalent brand) Double-face Foam Adhesive-tape, enabling the assembly to be readily permanently mounted upon a clean tile or painted shower-wall surface without fear of its cantilevered mounting drawing the mentioned support-bracket extend well down below the horizontal plane of tape contact, thereby greatly reducing the outward bending moment-arm load imposed upon the adhesive material. Because of the freedom of mounting advantage provided by this embodiment, it may be stationed at virtually any vertical height determined appropriately convenient to the particular height of the user. Or, an alternate embodiment of this invention offers: 2.) a header-plate which is preferably configured with an integral knurled-handnut and splined female gripper-sleeve arrangement which may be readily secured upon the existing wall water-outlet pipe. This mounting means thus serves to maintain the header-plate firmly in place against the wall, while the downwardly extending portion of the header-plate acts resultantly against the wall owing to the outward bending moment-arm load imposed upon the described securing joint, which in turn translates into a constant compression-load below the joint owing to the cantilevered position of the overhead showering manifold portion. Since this embodiment necessarily secures upon the relatively low-positioned (typically) existing shower-wall water outlet-pipe, it also features an upwardly extending supporting structure capable of elevating the showering-manifold portion preferably another 10–12-inches above the outletpipe so as to clear the head of a taller %-tile person.

B.) Another object of this invention is to provide generic species variants featuring different types of showering nozzle methods and arrangements as follow: a.) a basic annular or otherwise minimally U-shaped water-manifold portion having a plurality of outlet perforations as showering nozzle like entities, possible in combination with the existing wall shower-nozzle unit which may be thus selectively controled independently via a substantially conveniently water/divertor-valve; or, b.) via the same sort of manifolding arrangement as described in item-a above, but provided with several conventional ball-socket mounted sprayhead-nozzles, such as one each right and left plus a third centrally distal one, again any one of which may be provided with a conventional shut-off valve of one sort or another.

C.) Another object of this invention is to provide generic species variants offering a choice of showering-manifold construction configurations: a.) a basic annular shower-manifold having a tubular cross-section, which may be actually injection-moldedin two plastic halfs (top and bottom parts) which are preferably chemically bonded permanently together to create the hollow tube like manifold structure; or, b.) a one-piece molded-plastic affair having a U-shaped cross-section which appears ostensibly tubular as viewed from a normal eye vantage-point below the installation, whereby in fact the U-cavity (accessible from above) would contain a small approximately ¼-inch/I.D. polyethylene tube connecting an array of small shower-nozzles via a T-fitting arrangement above each nozzle. The advantage of this latter arrangement lays in its more economically molded cross-section shape when employing volume injection-molding die-tooling.

D.) Another object of this invention is to provide a showering apparatus for original residential or institutional stall-shower or tub-shower installation, or for economical improvement to an existing showering installation; whereby the user may enjoy the ambiance of a more all encompassing environmental 'mist' -like spray effect, provided the showering-manifold be so equipped with misting-nozzle members, since given a nominal 24-inch average width (measuring left to right, as one is facing the wall installed apparatus) of the showering-manifold, a substantial area of spray activity is being treated.

BRIEF DESCRIPTION OF THE DRAWING FIGURES

The foregoing and still other objects of this invention will become fully apparent, along with various advantages and features of novelty residing in the present embodiments, from study of the following description of the variant generic species embodiments and study of the ensuing description of these embodiments, wherein indica of reference are shown to match related points given in the text, as well as the Claims section annexed hereto; and accordingly, a better understanding of the invention and the variant uses is intended, by reference to the drawings, which are considered as primarily exemplary and not to be therefore construed as restrictive in nature.

FIG. 1, is a pictorial view of a preferred generic species variant embodiment of the invention, showing essentially how it would appear installed against an existing shower-wall surface.

FIG. 2, is a side-elevation cross-section view of previous FIG. 1 specimen, wherein is revealed the preferred elements of construction.

FIG. 3, is a detail cross-sectional view of the bracket-body portion as shown in FIG. 2 and according to reference arrows 3:3.

FIG. 4, is a frontal view of FIG. 3, showing how the gripper-sleeve is constructed.

FIG. 5, is a pictorial view of an alternate generic species variant embodiment of the invention, showing essentially how it would appear installed upon an existing shower-wall surface.

FIG. 6, is a side-elevation cross-sectional view of previous FIG. 5 specimen, wherein is revealed the preferred elements of construction.

FIG. 7, is a rear elevation-view of the bracket-body portion as set forth in FIG. 6, revealing the special wall attachment arrangement.

FIG. 8, is an enlarged detail cross-sectional view of the showering-manifold portion referenced in FIG. 6 as view 8:8.

INVENTION NOMENCLATURE

10—overall invention assembly
11—existing wall supply-pipe
12—existing wall-surface
13—female pipe-threads of gripper-sleeve
14—handnut
15/& 15*a*, 15*b*, 15*c*—gripper-sleeve/& individual fingers thereof
16, 16', 16''—serrations forming four griping fingers
17—existing threaded-elbow portion
18—existing showering-nozzle
19—water-conduit
20—showering-manifold body
21/21', 21''—lower pressure-plate portions
22, 22'—upper bracket-arm portions
23—existing wall-supplypipe hole
24—provisional soap-shelf
25—provisional towel-bar
26—conduit fascia-duct
27—unassigned
28—unassigned
29—unassigned
30—manifold supporting channel
31—upper planar header-plate
32', 32''—left & right bracket-arm portions
33—adhesive attachment surface
34—double-face adhesive foam-tape
35—U-channel cavity
36—water conduit tube
37—tube T-junction plurality
38—exemplified spray-nozzle plurality
39', 39''—vertically bifurcated U-channel walls
40, 40'—conventional 3-way fitting, or divertor-valve

DETAILED DESCRIPTION OF THE PREFERRED EMBODIMENTS

Initial reference to the drawings is given by way of FIG. 1, wherein is shown a stall-shower or tub-shower installation of a complete assembly of the invention 10 which embodiment utilizes the existing water-outlet supply-pipe 11 for semi-permanent attachment against the wall-surface 12. Since the pipe 11 exits the wall at a usual height of only about 5'10" above the shower-floor surface, a wall interfacing header-plate portion 21 of the structure is arranged both vertically and rigidly so as to feature a special hand-tightened handnut 14 and gripper-sleeve arrangement facilitating secure mounting upon the male like outside body surface of the said supply-pipe 11, which may also allow retaining of the existing conventional showering-nozzle 18 necessarily removed during slip-on installation of the header-plate's gripper-sleeve 15.

Note here, that a conventional flexible water-conduit line 19 is preferably routed 180-degrees back toward the wall where it may enter the integrally formed fascia-duct 26, the conduit 19 serving to thus feed water from a provisional T-fitting 40 to the special showering-manifold 20; most users prefering the said T-fitting be a 3-way divertor-valve 40 of conventional design ref. FIG. 2 potentially capable of manually redirecting water flow out the existing nozzle 18 only, or, out the showering-manifold nozzles 38 only, or, simultaneously out through both the said members 18 and 38 if desired.

Study of FIGS. 2 & 3 show how the prevailing outwardly cantilevering load component (arrow-LC) is directed downward against the wall-surface 12 through the rigid bracket-body portions 22 and 22' into the header-plate portion 21, while being retained at what is rather tantamount to a fulcrum-point (arrow-FP).

Accordingly, study of FIG. 3 reveals in detail how the female pipe-threads 13 of the handnut 14 act on the female pipe-threads of the gripper-sleeve 15 so as to facilitate a progressively tightening action down upon the pipe 11, as the preferably manually turned handnut 14 is turned further upon the gripper-sleeve fingers. FIG. 4 shows how the gripper-fingers 15*a*, 15*b*, 15*c*, are formed by the three serration-cuts 16, 16', 16'' made radially into the gripper-sleeve body end, and bear tightly upon the pipe 11 as necessary to attain a secure installation. In some cases where the pipe 11 is more sharply curved, the pipe 11 can be momentarily removed from the wall via the threaded portion concealed therein at 17, enabling the pipe to be placed through the gripper-sleeve 15 while the header-plate portion 21 is positioned over the pipe's exit hole 23. Note that the integral soap-tray 24 is merely an optional convenience feature of the structure Next, FIG. 5 sets forth an alternate generic species featuring a different method of securing the assembly against the wall. Here is shown a special header-plate configuration 31 having dual opposed arm like bracket-bodies 32' (right) and 32'' (left) which stem down from the annular water-manifold supporting-body portion 30 to directly contact the wall surface 12, the prevailing outward cantilevering load component (arrow-LC) thus bearing down against the wall below since the rigid structure is retained fast thereabove along horizontal retention area 33 which is rather tantamount to a fulcrum-point (arrow-FP) best seen in FIG. 6. Accordingly, it is understood that the greater the distance the arms reach down from the showering-manifold 31 past the FP, the lesser the strain tending to break loose the 3M type double-face foam adhesive-tape 34 applied along the straight flat back surface 33 herein regarded as the header-plate 31 as is better revealed in FIGS. 6 & 7.

In contrast to the hollow-core construction of the showering-manifold portion set forth in FIGS. 1 & 2. FIGS. 5 & 6 present an alternate embodiment for a showering-manifold portion 30 featuring ā U-channel cavity 35 into which a separate plastic water conduit tube 36 may be insertively contained yet while normally concealed from view of the user, thereby maintaining the essentially clean attractive visual lines of the first disclosed embodiment. Note here, that the water-conduit 36 is easily adapted with a plurality of spray-nozzle outlets 38 of conventional design, through use of standard T-shaped conduit junctions spaced at any desired intervals thereto; the spray-nozzles (or showering-nozzles per'se) merely exiting the underside of the semi-circular channel 30. Also, it should be noted that the vertical bifurcations 39'/39" comprising the U-shaped showering-manifold support-body portion are relatively easily molded as a one-piece structure, versus the essentially two-piece structure (upper ring 20 and supporting fixture portions 21, 22/22') required in the case of a molded plastic showering-manifold of the sort introduced in FIGS. 1 & 2 for example. Alternatively however, the hollow-core molded type of FIGS. 1 & 2 is substantially more easily fabricated with a myraid number of bottom showering outlet perforations in liew of actual showering-nozzles per'se, since these perforations are easily accomplished as provision of the molding-die; although if an annular metal showering-manifold were adapted to the cantilevering structure from stainless steel tube-stock, the showering perforations would be installed by other well known means, such as drilling or piercing.

A good average length for the bracket-body to extend down below the horizontal header-plate of this embodiment is about 10-inches, since to extend much further down would in of itself tend to impose additional cantilevered weight load exertion upon the adhesive strip 34. Naturally the particular advantage of this alternate embodiment is in the manner by which it may be virtually installed at any height above or below the existing supply-pipe 11, although because of the weight involved, it is preferred that the assembly be installed upon smooth dry clean ceramic-tile rather than onto a merely painted wall-surface.

Notice also in FIGS 1, 2, 5, 6, that the water-conduit line 19 may be arranged to route into the showering-manifold member at virtually any convenient attitude and position. Additionally, the added convenience of a handy soap-shelf 24 is easily molded into the structure along with a towel-bar 25, since such surface formation undulations actually serve to enhance the structural rigidity of the header-plate relative to the bracket-body formation thereto. Also, it is obvious that while a simple handnut 14 is preferred by way of eliminating need for any installation tools, some models featuring the gripper-sleeve mounting means might utilize a regular hexnut or spline-nut for wrench application. If the dual lateral brackets 32'/32" are not employed, in favor of a more horizontal bracket-body 22 which extends transversley left to right much as a flange like portion, then a very similar degree of structural rigidity can be attained between the manifold types 20 or 30 and the header-plates type 21 or 31 reviewed earlier; moreover, any combination of these arrangements may be resorted to.

Finally, it is understood that the utility of the foregoing adaptations of this invention are not dependent upon any prevailing invention patent necessarily; and while the present invention has been well described hereinbefore by way of several preferred embodiments, -it is to be realized that various changes, alterations, rearrangements, and obvious modifications may be resorted to by those skilled in the art to which it relates, without substantially departing from the implied spirit and scope of the invention. Therefore, the invention has been disclosed herein by way of example and not via thus imposed limitation.

What we claim of exclusive proprietary origin is:

1. A water showering apparatus provided with convenient mounting around an existing water supply pipe against an existing vertical wall of a stall-shower or tub-shower installation comprising:

a generally vertical rigid header plate having a water manifold portion cantilevered from an upper portion thereof;

said water manifold portion extending away from said header plate and including a plurality of spaced shower heads;

a fluid conduit arranged in communication between said existing water supply pipe and said water manifold, to provide for flow of water through said manifold and said shower heads;

said header plate includes a flat rigid substantially vertical surface area formed on one side thereof and having an aperture formed therethrough to accommodate said existing water supply pipe, the surface opposite said one side including a gripper sleeve formed around said aperture including an outwardly projecting threaded sleeve portion having a plurality of gripper sleeve fingers;

a nut having threads which cooperate with the threads of said sleeve portion such that when said nut is threaded onto said sleeve portion said fingers will be biased into peripheral contact with said water supply pipe with said vertical surface area forced against said existing vertical wall to thereby provide support for said cantilevered water manifold.

2. A wall supported showering apparatus according to claim 1, wherein the said water manifold portion is of a substantially annular formation as viewed in planview.

3. A wall supported showering apparatus according to claim 1, wherein said water manifold is substantially circular in plan view formation, wherein the cross-section thereof is a self-supporting tubular formation capable of feeding water within to said plurality of spaced showerheads.

4. A wall supported showering apparatus according to claim 1, wherein said fluid conduit includes a substantially conventional 3-way divertor valve member enabling the user to thereby manually select use of: a.) the existing wall supply pipe or b) said shower manifold, or the combination of both.

5. A wall supported showering apparatus according to claim 1, wherein said said heuter plate includes right and left support arm like entities stemming outward therefrom so as to uphold said water manifold portion; hence, effectively directing the prevailing outward load component of said cantilevered manifold downward through said header plate and against said existing wall surface.

* * * * *